US006524078B1

(12) United States Patent
Brooks et al.

(10) Patent No.: US 6,524,078 B1
(45) Date of Patent: Feb. 25, 2003

(54) POND PUMP WITH REVERSING MEANS TO PREVENT ROTATION IN THE OPPOSITE DIRECTION

(75) Inventors: Steve Martin Brooks, Surrey (GB); Robert Weidemann, Middlesex (GB)

(73) Assignee: Pet Mate Ltd. (GB)

( * ) Notice: Subject to any disclaimer, the term of this patent is extended or adjusted under 35 U.S.C. 154(b) by 55 days.

(21) Appl. No.: 09/631,754

(22) Filed: Aug. 3, 2000

(30) Foreign Application Priority Data

Aug. 4, 1999 (GB) ..... 9918404

(51) Int. Cl.[7] ..... F04B 49/00

(52) U.S. Cl. ..... 417/223; 417/214; 417/423.1; 415/122.1; 416/236 R; 416/236 A; 416/172

(58) Field of Search ..... 417/214, 423.1, 417/223; 416/236 R, 236 A, 172; 415/122.1

(56) References Cited

U.S. PATENT DOCUMENTS

| | | | |
|---|---|---|---|
| 4,750,872 | A | 6/1988 | Palliser |
| 5,039,286 | A | 8/1991 | Point et al. |

FOREIGN PATENT DOCUMENTS

| | | | |
|---|---|---|---|
| EP | 0 148 343 | B | 6/1987 |
| EP | 0 383 | | 8/1990 |
| EP | 383 464 | A2 | 8/1990 |
| EP | 501 109 | A1 | 9/1992 |
| GB | 361656 | A | 11/1981 |
| WO | WO 99/35403 | * | 7/1999 |

OTHER PUBLICATIONS

Search Report from the priority British application, Jan. 28, 2000.

European Search Report dated Mar. 1, 2001, corresponding to co–pending European Patent Application No. 00 30 6509.

* cited by examiner

*Primary Examiner*—Charles G. Freay
*Assistant Examiner*—W Rodriguez
(74) *Attorney, Agent, or Firm*—H.T. Than Law Group

(57) ABSTRACT

A pond pump having a housing (1) enclosing a synchronous motor (9) with a drive shaft (40) on which an impeller (20) is loosely fitted so that, on start up, the shaft (40) can rotate relative to the impeller (20) until a pair of diametrically opposed keyways (43) on the shaft engage and entrain keyways (27) on the impeller (20) to rotate it continuously in one direction. If the drive shaft initially rotates in the opposite direction, pegs (25) on the rear face of the impeller (20) engage with a detent (60) located behind the impeller (20) to stop said rotation until the motor (9) restarts and rotates the drive shaft (43) in said first direction. One end of the drive shaft (40) is received in a first bearing (50) mounted in the housing (1), the other end of said shaft being received in a blind bore (28) in the impeller (20) which is coaxial with the axis of rotation of the shaft (40). The impeller (20) has a spigot (23) extending from the front face thereof which is received in a second bearing (50*a*) in the housing (1).

13 Claims, 4 Drawing Sheets

POND PUMP WITH REVERSING MEANS TO PREVENT ROTATION IN THE OPPOSITE DIRECTION

FIELD OF THE INVENTION

This invention relates to pumps and more particularly to pumps which can be used to recirculate water from a lower level to a higher level in, for instance, a pond, fountain or waterfall.

BACKGROUND OF THE INVENTION

An important objective in the design of a pond pump is that it must be relatively maintenance free and reliable as it is rarely serviced or maintained after installation. One of the problems in designing such pumps is to ensure that dirt, grit or other foreign matter does not get into the areas of the pump where it can cause excessive wear leading to the pump working intermittently or even seizing completely.

DESCRIPTION OF THE PRIOR ART

A problem with known pumps is that the impeller is generally mounted directly on the output shaft of the motor. As a result of significant pressure differences across the impeller, a substantial flow of water together with grit and other foreign matter can find its way between the impeller and shaft causing damage and wear resulting in the impeller becoming a loose fit on the shaft which can cause vibration and failure. This problem has been overcome in the prior art by either making the impeller an extremely close fit on the rotor shaft to prevent the passage of foreign matter or making it a very loose fit which allows the foreign easy. The problem with the former solution is that it requires very tight manufacturing tolerances which may not be achievable at reasonable cost. As far as the latter solution is concerned, making the impeller a loose fit on the shaft means that it wears much more quickly and cannot be constructed to a high efficiency.

Another problem with pumps of the prior art is that because they use a synchronous motor to rotate the impeller, the motor can start in either direction so the pump may include a mechanism which can reverse the direction of rotation should it be the wrong way. This is generally done using detent which is deflected out of the path of rotation of the blades of the impeller when it is rotated in its correct direction of rotation but obturates the path of the blades in the opposite direction of rotation. Thus, should the motor start to rotate the impeller in the wrong direction, before it has rotated through 360°, the blade will engage with the now fixed detent which cannot move out of its way. As a result, the detent temporarily stops rotation of the impeller and the rotor shaft in a predetermined position in which the magnetic field of the motor will cause it to rotate in the opposite direction. The impeller blades can then deflect the detent out of their way on each revolution so the impeller continues to rotate in the correct direction of rotation for pumping. The problem with these prior art arrangements is that the detent is located in the pumping chamber and therefore has to engage directly with the blades of the impeller. This means that the reversing mechanism is exposed to foreign matter in the pumping chamber such as grit or shredded plant or animal matter which can cause it to seize or work intermittently. Furthermore, because the detent engages with the blades of the impeller themselves, and it must stop the impeller at a predetermined position, the impeller design is compromised which limits the design and performance of the pump.

SUMMARY OF THE INVENTION

It is an object of the present invention therefore to provide a pump in which the impeller is mounted on the rotor shaft of the electric motor in such a way that dirt, grit or foreign matter are not entrained between said shaft and impeller to cause damage and wear thereto by eliminating the flow of water between said ports.

According to the invention therefore there is provided a pond pump comprising an electric motor enclosed in a casing having a pumping chamber with an impeller mounted thereon to pump water supplied to said chamber to an outlet, and reversing means operable to allow the impeller to rotate continuously in one direction only, with abutment means on the impeller to prevent rotation thereof in the opposite direction, wherein said reversing means is mounted on the casing and located in the pumping chamber directly behind the impeller.

Preferably the impeller has a front face and a rear face and the reversing means comprises a detent or pawl which engages with said abutment means which extend from the rear face of the impeller. The abutment means can comprise a single protrusion which extends from the rear face of the impeller but preferably comprises a pair of diametrically opposed protrusions.

In the preferred embodiment, the pumping chamber has an end wall and the reversing means are located in a recess in said end wall which is juxtaposed with the rear face of the impeller.

The impeller preferably has three blades on its front face, each blade radiating outwardly from the axis of rotation of the impeller, the end of each blade at or adjacent the perimeter of the impeller being circumferentially spaced from an adjacent blade by 120°. However, any number of blades can be provided on the impeller.

In a preferred embodiment, the motor has a drive shaft one end of which is received in a first bearing mounted in the casing, the other end being received in a blind bore in the impeller which is coaxial with the axis of rotation of the shaft, the impeller having shaft mounting means extending therefrom coaxial with the axis of rotation of the shaft which are received in a second bearing in the housing.

Conveniently the shaft mounting means on the impeller comprises a first spigot which extends from the front face of the impeller coaxial with the axis of rotation thereof.

Preferably, the blind bore has an end wall with a second spigot extending therefrom coaxial with the axis of rotation of the impeller. In the preferred embodiment, the end of the drive shaft has a coaxial aperture therein which receives and mounts the second spigot of the impeller and the first spigot is received in said second bearing in the pump housing.

DETAILED DESCRIPTION OF A PREFERRED EMBODIMENT

A preferred embodiment of the invention will now be described, by way of example only, with reference to the accompanying drawings.

Figure 1:
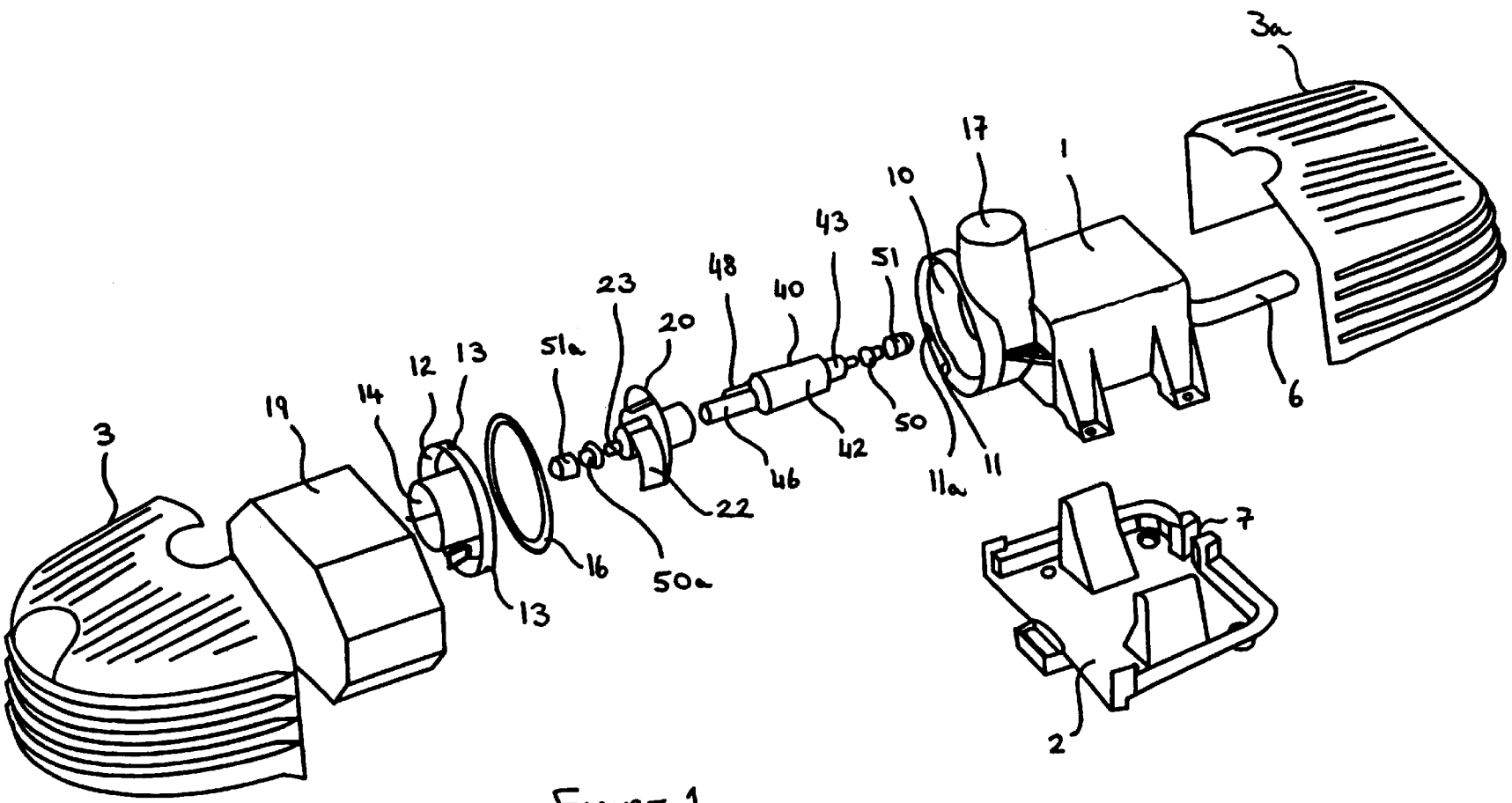
FIG. 1 is an exploded view of a pump of the present invention.

Referring first to FIG. 1, there is shown a pump of the present invention which is primarily intended for use in ornamental ponds, waterfalls or water features where it is required to pump water from one level to another. A synchronous motor 9 (best illustrated in FIG. 10) is mounted in housing 1 which has a pumping chamber 10 with a water inlet 14 thereto and a water outlet 17 extending therefrom. A rotatable impeller 20 is mounted in the pumping chamber 10 on rotatable rotor 40 of the synchronous motor 9. The pumping chamber 10 is closed by a removable cover 12 in which the water inlet 14 is formed. Electric power for the synchronous motor 9 is supplied via electric cable 6 and the whole assembly is encased in two outer cover halves 3,3*a*. A foam filter 19 is located in the front cover 3 immediately adjacent the water inlet 14.

The synchronous motor 9 and associated parts are encased in the housing 1 in a watertight manner. The housing 1 is attached in known manner to base 2 by location means. An aperture 7 is also provided in one side of the base to allow access for the wire 6 to the interior of the housing 1.

The various components making up the pump 9 will now be described in more detail.

Figure 2:
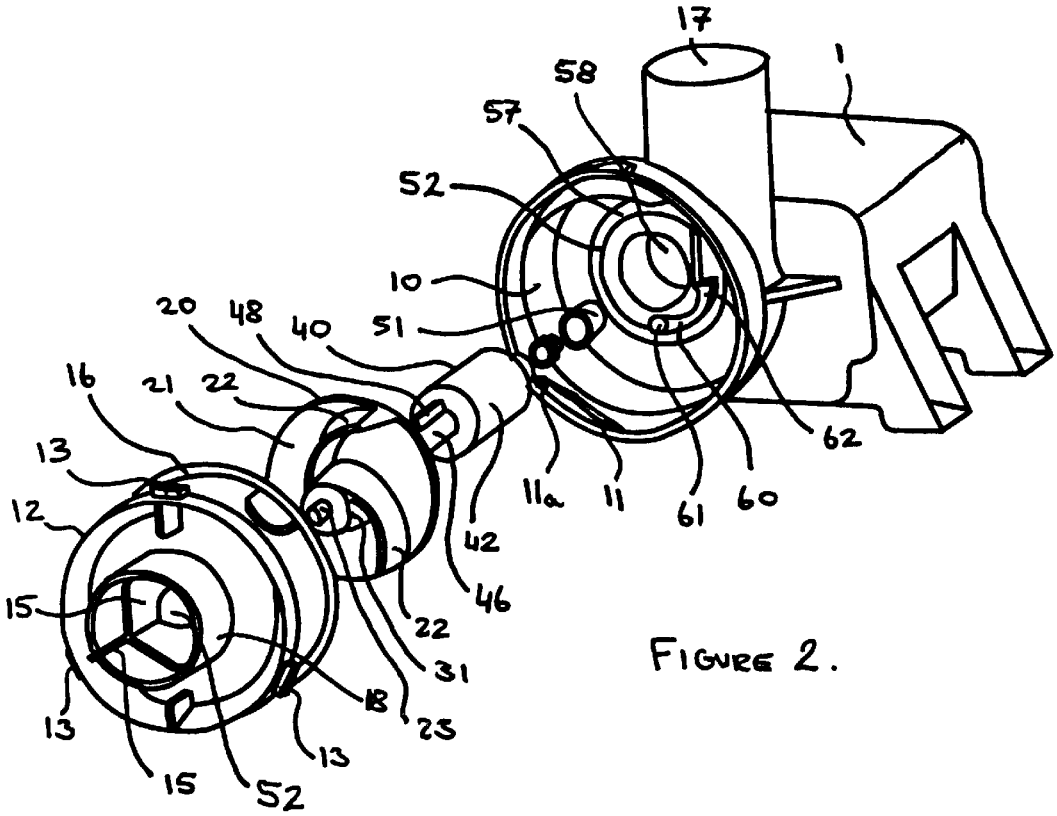
FIG. 2 is an enlarged exploded view of parts of the pump shown in FIG. 1.
Figure 10:
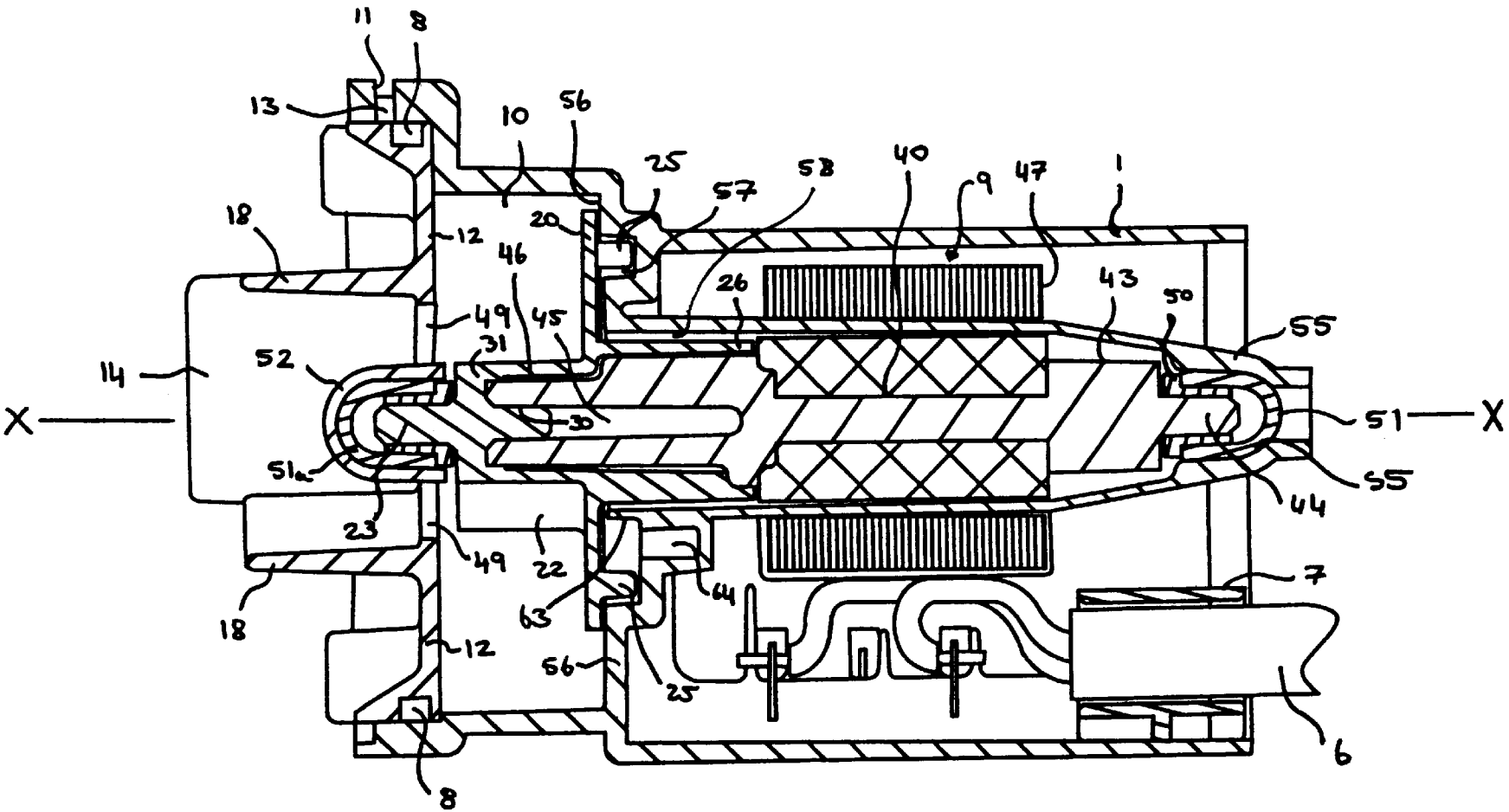
FIG. 10 is a cross sectional view through the pump shown in FIG. 1 but omitting the outer covers and foam filter.

Referring first to FIGS. 2 and 10, it can be seen that the housing 1 is formed with an open ended pumping chamber 10 closed by a removable cover 12 fitted thereto. The cover 12 has three tabs 13 extending radially outwardly therefrom which engage in slots 11 in the sidewall of open end of the pumping chamber 10 whereby when the cover 12 is rotated, the tabs 13 move along the slots 11 until they locate in recesses 11*a* in known manner to releasably attach the cover 12 to the housing 1 (see FIG. 1). The periphery of the cover 12 also has an annular rebate 8 formed therein which receives and locates an O-ring 16 (see FIG. 2) to provide a fluidtight seal between the cover 12 and the housing 1. As the cover 12 is releasably fitted to the housing 1 in a known manner using the illustrated bayonet connection, no further detailed description thereof will be given.

As can be seen more clearly from FIG. 2, the cover 12 has a forwardly extending tubular extension 18 in which the water inlet 14 is located, the inlet being divided by three vanes 15 which are circumferentially spaced from each other by 120°. A bearing mounting 52 is formed at the inner end of each vein 15 (see also FIG. 10) and openings 49 are circumferentially disposed around the bearing mounting 52 to allow water to pass into the water inlet 14, through the tubular extension 18, through the apertures 49 and into the pumping chamber 10.

Referring again to FIG. 10, the pumping chamber 10 has a bottom or end wall 56 with a generally tubular portion 53 with a tapered end section 54 extending axially from the rear face thereof. A cup-shaped rubber bush 51 is fitted in bearing section 55 of the portion 53 and a ceramic bearing 50 is received therein in known manner. A similar cup-shaped rubber bush 51*a* is fitted in bearing mounting section 52 in the cover 12 and a ceramic bush 50*a* is fitted therein in known manner. The bearings 50,50*a* fitted in the rubber bushes 51,51*a* are axially aligned as illustrated and support the rotor 40 of motor 9 for rotation therein about longitudinal axis X—X.

Figure 3:
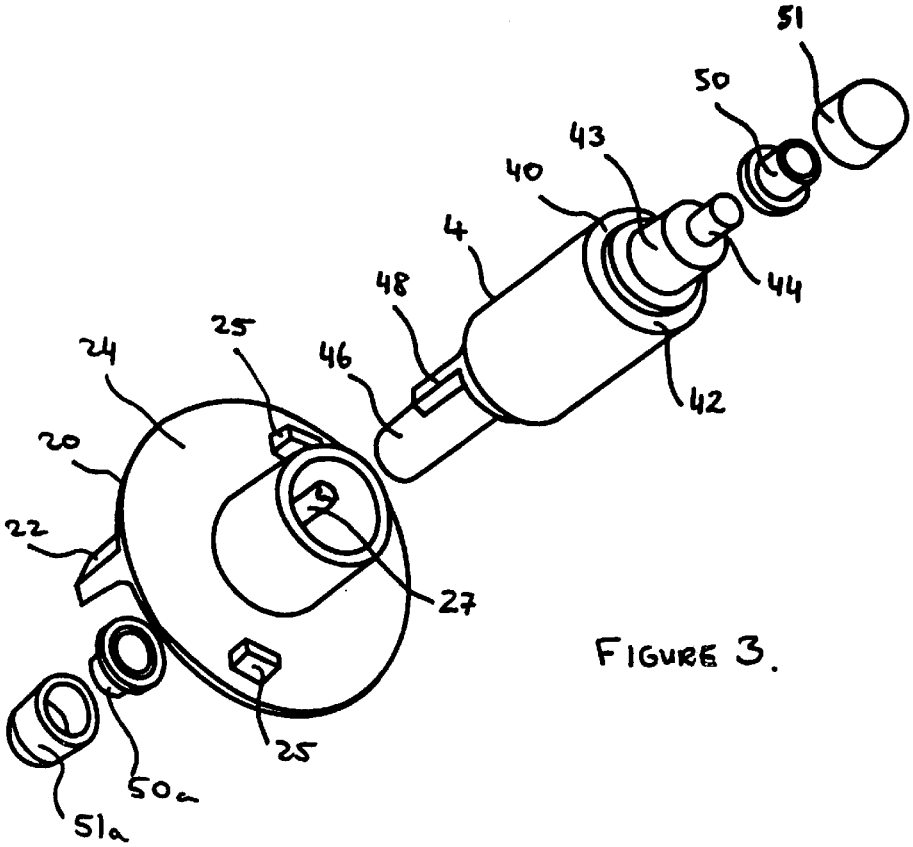
FIG. 3 is an exploded view of some of the parts shown in FIG. 2 on an enlarged scale.
Figure 4:
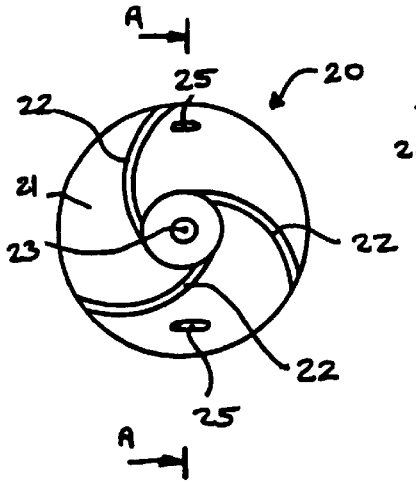
FIG. 4 is a front view of the impeller shown in the pump of FIGS. 13.
Figure 5:
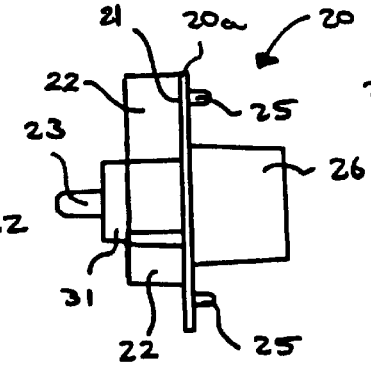
FIG. 5 is a side view of the impeller shown in FIG. 4.
Figure 6:
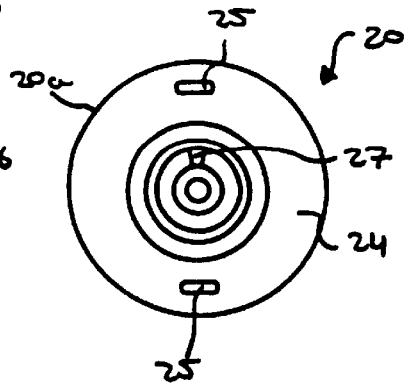
FIG. 6 is rear view of the impeller shown in FIGS. 4 and 5.
Figure 7:
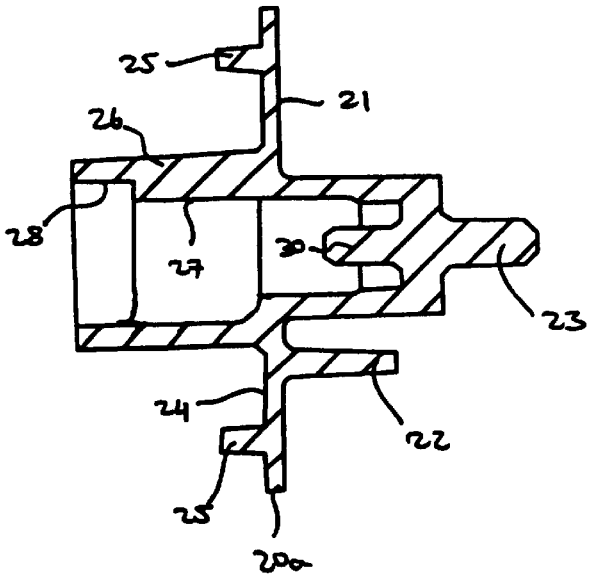
FIG. 7 is a cross section on line A—A through the impeller shown in FIGS. 4–6 on an enlarged scale.
Figure 8:
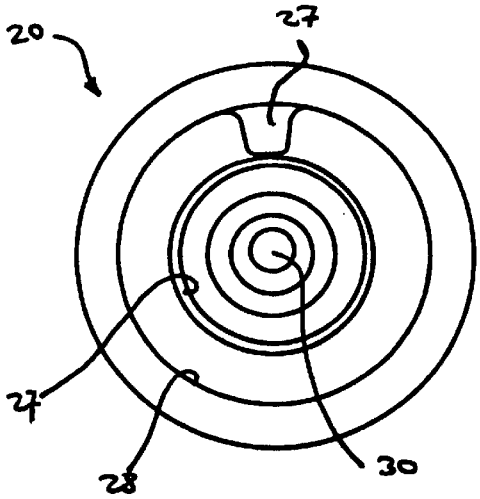
FIG. 8 is an enlarged view of the detail Y shown in FIG. 6.
Figure 9:
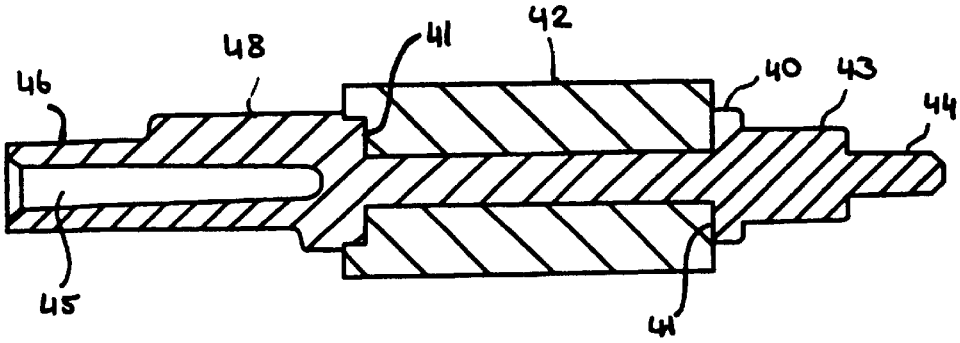
FIG. 9 is a cross sectional view through the rotor of the motor in the pump shown in FIGS. 1–8.

The synchronous motor 9 is mounted in the housing 1 as illustrated in FIG. 10 and includes steel laminations 47 between which the rotor 40 is rotatable in known manner. As can be better seen from FIG. 9, the rotor 40 comprises a moulded plastics shaft 40 having a recessed mid-section 41 in which a magnet 42 is fixedly mounted. The right-hand end of the shaft as viewed in FIG. 9 has a tubular section 43 of reduced diameter with a spigot 44 extending therefrom. The left-hand end of the shaft as viewed in FIG. 9 comprises a tubular end section 46 with a coaxial bore 45 extending therethrough. A keyway 48 is formed on the section 46 adjacent the magnet 42. The keyway 48 is better illustrated in FIGS. 2 and 3.

FIGS. 4–8 illustrate the impeller 20 in more detail and it can be seen that it comprises a circular disc 20*a* having a front face 21 and a rear face 24. A tubular section 31 extends forwardly from the front face 21 of the impeller 20 and has a spigot 23 formed thereon which is coaxial with the axis of rotation of the impeller. A second tubular section 26 of increased diameter extends from the rear face 24 of the impeller 20. A blind bore 28 extends through the tubular sections 26 and 31 coaxial with the axis of rotation of the impeller 20. A pair of keyways 27 are located in the bore 28 diametrically opposite each other and a spigot 30 extends from the end wall of the bore 28 coaxial with the spigot 23 and the axis of rotation of the impeller 20. Three blades or vanes 22 radiate outwardly from the tubular section 31 on the front face of the impeller, said vanes being curved along their length as illustrated. The end of each vane 22 where it meets the periphery of the impeller 20 is circumferentially spaced by 120° from an adjacent vane. Whilst three vanes 22 are illustrated, any number of vanes can be provided.

A pair of diametrically opposed projections or pegs 25 extend from the rear face 24 of the impeller 20, parallel to the axis of rotation of the impeller.

Referring now to FIG. 2, it can be seen that a detent 60 is mounted on the end wall 56 of the pumping chamber 10 to pivot about pin 61. The end wall 56 has a central aperture 58 extending therethrough and is surrounded by an annular groove or recess 57. The detent 60 is spring biased to normally protrude into the annular recess 57 but it can be moved out of the way in a manner to be described hereafter. The depth of the annular groove 57 is constant around its entire circumference except in the area where the detent 60 is located where it widens as shown at 63 in FIG. 10 to accommodate the detent 60.

As can be seen more clearly from FIG. 10, the impeller 20 is fitted to the end of the rotor 40 by inserting the spigot 30 in the open end of bore 45 in the rotor. A ceramic bearing 50a is fitted to the spigot 23 which extends from the end of the impeller 20 and this is received in rubber bush 51*a* which is itself mounted in bush mounting 52 which is part of the end cover 12. The spigot 44 at the other end of the rotor 40 is also mounted in a ceramic bearing 50 which is received in rubber bush 51 mounted in section 55 of the casing 1.

As can be seen from FIG. 10, the two pegs 25 which protrude from the rear face 24 of the impeller 20 locate in the annular groove 57 and travel around it when the impeller is rotated by the rotor 40. It will also be noted that the detent 60 is located behind and immediately adjacent the rear face of the impeller 20 in the enlarged recess 63, the pivot pin 61 being received in recess 64. As a result, partly due to centrifugal force but also because there is no flow path, any matter or debris which may enter the pumping chamber 10 cannot find its way into the detent mechanism so it is protected and longevity of the mechanism in operation is ensured. In prior art pumps, the detent 60 is located in front of the impeller in the pumping chamber 10 so any debris or foreign matter in the chamber 10 can interfere with its regular operation.

It should be noted that the impeller 20 is a loose fit on the tubular section 46 of the rotor 40. Thus, when the rotor 40 is rotated on startup of the motor, the impeller 20 remains stationary but the keyway 48 on the rotor 40 will rotate relative to the stationary impeller 20 until they abut the keyway 27 on the inside of section 26 thereof When this happens, the keyway 27 is entrained by the keyway 48 on the rotor 40 and the impeller 20 is rotated.

It should be noted that the synchronous motor 9 can start to rotate in either direction when a current is supplied thereto. The required direction of rotation in the illustrated pump is anti-clockwise in order to pump water in the chamber 10 out of the outlet 17 (see FIG. 2). When the impeller 20 is rotated anti-clockwise, the pegs 25 travel around the central aperture 58 in the annular groove 57 and deflect the detent 60 out of their path. Thus, any water coming into the inlet 14 and chamber 10 is pumped out through the outlet 17 (see FIG. 1). If however the motor starts in the opposite direction, i.e. clockwise, the keyway 48 engages with the keyway 27 on the inside of the section 26 of the impeller 20 and the impeller is initially rotated in a clockwise direction. However, its clockwise rotation will be stopped as soon as the leading peg 25 abuts end face 62 on the detent 60, which is pushed outwardly by the water flow or gravity. When in this position however, the motor will quickly rephase itself and the rotor will then rotate in the opposite direction thereby allowing the pegs 25 to travel round in the groove 57 until the leading peg meets the detent 60 to deflect it out of its path again thereby allowing the continued rotation of the impeller in an anti-clockwise direction. This simple mechanism therefore ensures that the motor will always rotate the impeller in the required anti-clockwise direction even if it initially starts rotating in the opposite direction.

An important feature of the illustrated pump is that the impeller 20 is fitted on the end of the rotor 40 by inserting the spigot 30 into the aperture 45 therein. Because the blind bore 28 in the impeller is closed at its opposite end, there is no way that grit or other debris such as shredded fish, plant or animal life etc. can interfere with the fit of the impeller on the rotor 40. There is also no way that the water can flow through from the rear of the impeller 20 to the front face thereof. In the prior art, the impeller generally has a rotor hole all the way through it is so grit and other foreign material in the pumping chamber 10 tends to be induced between the impeller and the rotor 40 causing it to wear. In the prior art, this problem of wear was overcome by either making the impeller an extremely tight fit on the rotor 40 but sometimes the grit could wedge between the key-way and the impeller and cause the whole system to seize. The way of overcoming the seizing problem was to make the impeller a very loose fit on the rotor 40 but this was not very satisfactory either as it would wear extremely quickly and be inefficient. The arrangement of the present invention where the impeller is fitted onto the end of the rotor with a closed bore means that no grit or water can be pumped through and therefore these problems are all avoided.

A further important feature of the invention is that the mechanism for reversing the direction of rotation of the rotor 40 on initial start up is located behind the impeller and is therefore protected from any debris such as grit, weed, animal life or fish which may have been chewed up by the rotation of the impeller 20. Thus, longevity of operation of the reversing mechanism is enhanced as little or no foreign matter which can interfere with its performance can reach it. A further advantage is that in the prior art, the detent mechanism is located in front of the impeller and it cooperates directly with the impeller blades to reverse the direction of rotation thereof. As a result, the impeller of a prior art pump can only have two blades on it. With the pump of the present invention, any number of blades can be used on the front face of the impeller because it is the two pegs 25 on the rear face of the impeller which cooperate with the detent 60. In the illustrated embodiment, three blades are shown but it will be appreciated that any number of blades can be used as there is no need for cooperation between the detent 60 and the blades as this is taken care of by the pegs 25 on the rear face of the impeller 20.

What is claimed is:

1. A pond pump comprising an electric motor enclosed in a casing having a pumping chamber with an impeller mounted thereon to pump water supplied to said chamber to an outlet, said impeller including front and rear surfaces, and reversing means operable to allow the impeller to rotate continuously in one direction only, with abutment means on the rear face of the impeller to prevent rotation thereof in the opposite direction, wherein said reversing means is mounted on the casing and located in the pumping chamber directly behind the rear face of the impeller.

2. A pump as claimed in claim 1 wherein the reversing means comprises a detent or pawl which engages with said abutment means which extend from the rear face of the impeller.

3. A pump as claimed in claim 2 wherein the abutment means comprises a protrusion extending from the rear face of the impeller.

4. A pump as claimed in claim 2 wherein the abutment means comprises a pair of diametrically opposed protrusions extending from the rear face of the impeller.

5. A pump as claimed in claim 1 wherein the pumping chamber has an end wall and the reversing means are located in a recess in said end wall which is juxtaposed the rear face of the impeller.

6. A pump as claimed in claim 1 wherein three upstanding blades are provided on the front face of the impeller and each blade radiates outwardly from the axis of rotation of the impeller.

7. A pump as claimed in claim 6 wherein the end of each blade at or adjacent the perimeter of the impeller is circumferentially spaced from an adjacent blade by 120°.

8. A pond pump as claimed in claim 1 wherein the motor has a drive shaft one end of which is received in a first bearing mounted in the casing, the other end being received in a blind bore in the impeller which is coaxial with the axis of rotation of the shaft, the impeller having shaft mounting means extending therefrom coaxial with the axis of rotation of the shaft, said shaft mounting means being received in a second bearing in the casing.

9. A pump as claimed in claim 8 wherein the shaft mounting means on the impeller comprises a first spigot which extends from the front face of the impeller coaxial with the axis of rotation thereof.

10. A pump as claimed in claim 8 wherein the blind bore has an end wall and a second spigot extends from said end wall coaxial with the axis of rotation of the impeller.

11. A pump as claimed in claim 10 wherein said other end of the drive shaft has a coaxial aperture therein which receives and mounts the second spigot of the impeller.

12. A pond pump comprising an electric motor enclosed in a casing having a pumping chamber, a rotor, and an impeller to pump water supplied to said pumping chamber to an outlet, said impeller further including a frontface, a rear face, and a blind bore receiving one end of the rotor and said casing receiving the opposite end of said rotor, said blind bore further including a closed end for preventing fluid communication between said front and rear faces thereof.

13. A pond pump comprising an electric motor enclosed in a casing having a pumping chamber with an end wall, an impeller being mounted on the casing to pump water supplied to said pumping chamber to an outlet, and reversing means operable to allow the impeller to rotate continuously in one direction only, with abutment means on the impeller to prevent rotation thereof in the opposite direction, said reversing means being located in the pump behind the impeller and said reversing means are located in a recess in said end wall which is juxtaposed to rear face of the impeller.

* * * * *